US006428355B1

(12) United States Patent
Machado

(10) Patent No.: US 6,428,355 B1
(45) Date of Patent: Aug. 6, 2002

(54) COAXIAL CABLE ASSEMBLY

(75) Inventor: Manuel Machado, Hope, RI (US)

(73) Assignee: Antaya Technologies Corporation, Cranston, RI (US)

( * ) Notice: Subject to any disclaimer, the term of this patent is extended or adjusted under 35 U.S.C. 154(b) by 0 days.

(21) Appl. No.: 09/669,542

(22) Filed: Sep. 26, 2000

Related U.S. Application Data

(60) Provisional application No. 60/199,534, filed on Apr. 25, 2000.

(51) Int. Cl.[7] ..... H01R 9/05

(52) U.S. Cl. ..... 439/578; 439/581; 439/582; 439/63

(58) Field of Search ..... 439/578, 581, 439/582, 606, 610, 98, 63

(56) References Cited

U.S. PATENT DOCUMENTS

| | | | | | |
|---|---|---|---|---|---|
| 3,824,528 | A | * | 7/1974 | Esser | 439/578 |
| 3,905,668 | A | | 9/1975 | Gee | |
| 4,431,254 | A | | 2/1984 | Cartesse | |
| 4,759,730 | A | | 7/1988 | Sappington et al. | 439/622 |
| 4,911,660 | A | * | 3/1990 | Alf et al. | 439/582 |
| 5,061,206 | A | | 10/1991 | Kawanami et al. | 439/582 |
| 5,078,619 | A | * | 1/1992 | Whittle et al. | 439/578 |
| 5,092,784 | A | * | 3/1992 | de Mendez et al. | 439/578 |
| 5,246,384 | A | * | 9/1993 | Sato | 439/581 |
| 5,378,162 | A | | 1/1995 | Waible | 439/106 |
| 5,474,466 | A | | 12/1995 | Sakuraoka et al. | 439/319 |
| 5,577,935 | A | | 11/1996 | Harting et al. | 439/581 |
| 5,725,391 | A | | 3/1998 | Masuda et al. | 439/582 |
| 5,735,695 | A | * | 4/1998 | Heinrich | 439/581 |
| 5,735,711 | A | | 4/1998 | Fremgen | 439/578 |
| 5,766,036 | A | * | 6/1998 | Ahmad et al. | 439/578 |
| 5,882,226 | A | | 3/1999 | Bell et al. | 439/582 |
| 5,911,599 | A | | 6/1999 | Masuda | 439/610 |
| 5,931,698 | A | * | 8/1999 | Kodama | 439/578 |
| 5,984,724 | A | | 11/1999 | McNeel | 439/606 |

FOREIGN PATENT DOCUMENTS

| | | | | | |
|---|---|---|---|---|---|
| GB | 2187898 | A | * | 9/1987 | 439/581 |

* cited by examiner

*Primary Examiner*—Tho D. Ta
(74) *Attorney, Agent, or Firm*—Hamilton, Brook, Smith & Reynolds, P.C.

(57) ABSTRACT

The present invention provides a cable assembly including a coaxial cable having an inner core and an outer shield. First and second lead portions are connected to the coaxial cable. One of the lead portions is attached to the inner core and the other lead portion is attached to the outer shield. First and second connector members extend from respective first and second lead portions. The connector members are positioned in side by side relation for mating with side by side terminals.

41 Claims, 6 Drawing Sheets

COAXIAL CABLE ASSEMBLY

RELATED APPLICATIONS

This application claims the benefit of U.S. Provisional Application Number 60/199,534, filed on Apr. 25, 2000, the entire teachings of which are incorporated herein by reference.

BACKGROUND

Antennas formed on or within automotive glass, such as a windshield or rear window, are commonly connected to associated equipment (for example a telephone or radio), by a coaxial cable. Typically, the antenna is electrically connected to a pair of electrical terminals soldered to the glass. The coaxial cable is connected to the electrical terminals by an intermediate adapter. One end of the intermediate adapter is connected to the coaxial cable with a standard coaxial connection and the other end is connected to the electrical terminals with a pair of standard connectors. The intermediate adapter separates the coaxial arrangement into two separate leads for engagement with the electrical terminals. A drawback of such an arrangement is that the intermediate adapter causes some signal loss, thereby affecting the reception of the antenna.

SUMMARY

The present invention provides a cable assembly which electrically connects to a pair of electrical terminals in a simpler and more direct manner than in the prior art. The cable assembly includes a coaxial cable having an inner core and an outer shield. First and second lead portions are connected to the coaxial cable. One lead portion is attached to the inner core and the other lead portion is attached to the outer shield. First and second connector members extend from respective lead portions. The connector members are positioned in side by side relation for mating with side by side terminals.

In preferred embodiments, an insulative housing formed of molded polymer surrounds the lead portions and at least part of the connector members. The first and second connector members extend at an angle relative to the coaxial cable. At least one of the connector members is a female socket that is shaped for engaging a circular male terminal. The first and second lead portions are formed of sheet metal and include tabs for crimping to the inner core and outer shield of the coaxial cable. At least one of the connector members is attached to a lead portion by staking. The first and second lead portions are part of an insert wherein the first and second lead portions are joined together by a rib that is cut from the lead portions when the lead portions are crimped to the inner core and the outer shield. The rib provides proper spacing between the first and second connector members. In one embodiment, both connector members are female and extend out at a right angle relative to the coaxial cable. In another embodiment, one of the connector members is a female socket and the other is a circular male connector.

The present invention cable assembly allows a coaxial cable to be connected to a pair of side by side terminals in a simple compact manner without requiring an intermediate adapter. As a result, the cable assembly minimizes signal loss and at the same time provides a connector arrangement which can be engaged with mating terminals by employing a simple pushing motion. In addition, the cable assembly has a low profile which is a useful feature in the automotive field because it enables positioning in locations where space is limited.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
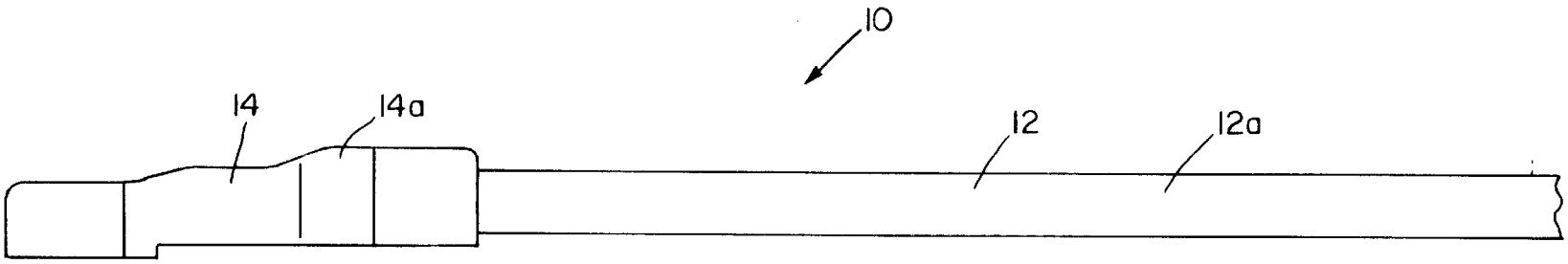
FIG. 1 is a side view of an embodiment of the present invention cable assembly.
Figure 2:
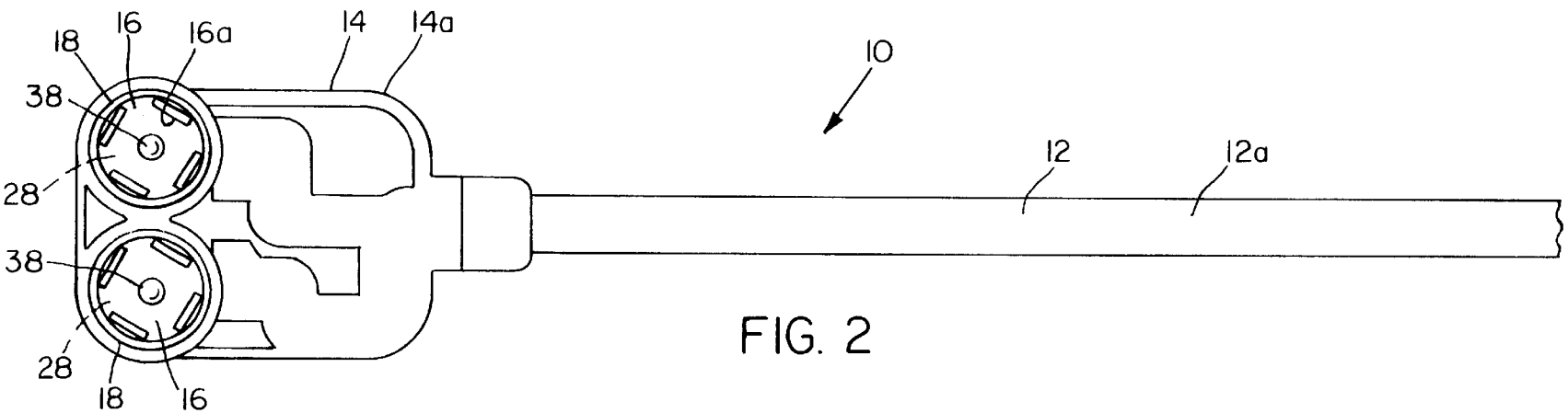
FIG. 2 is a bottom view of the cable assembly of FIG. 1.
Figure 3:
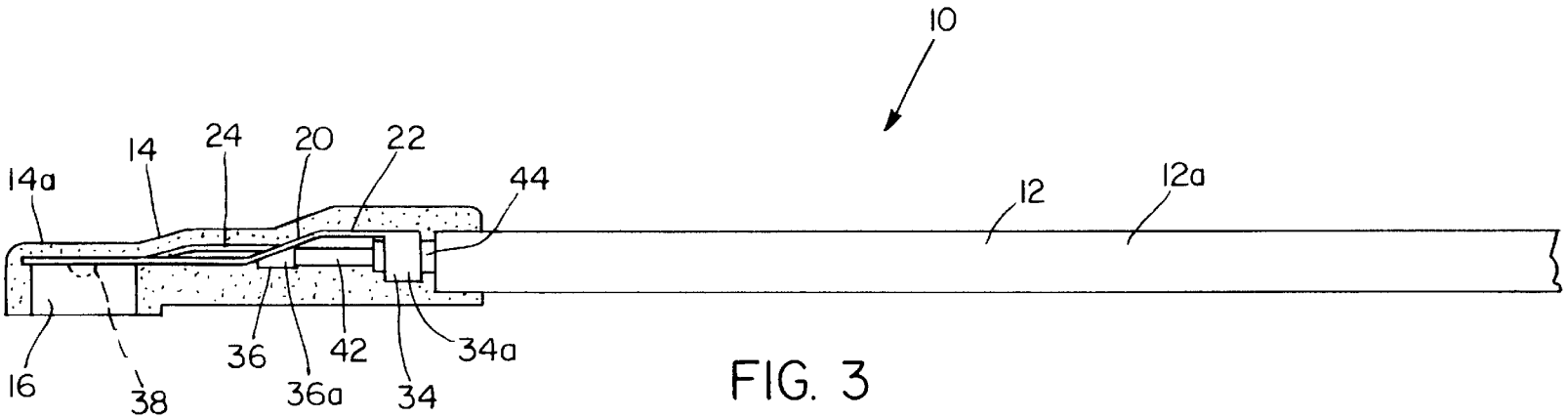
FIG. 3 is a side view of the cable assembly of FIG. 1 with the connector head shown in section.
Figure 4:
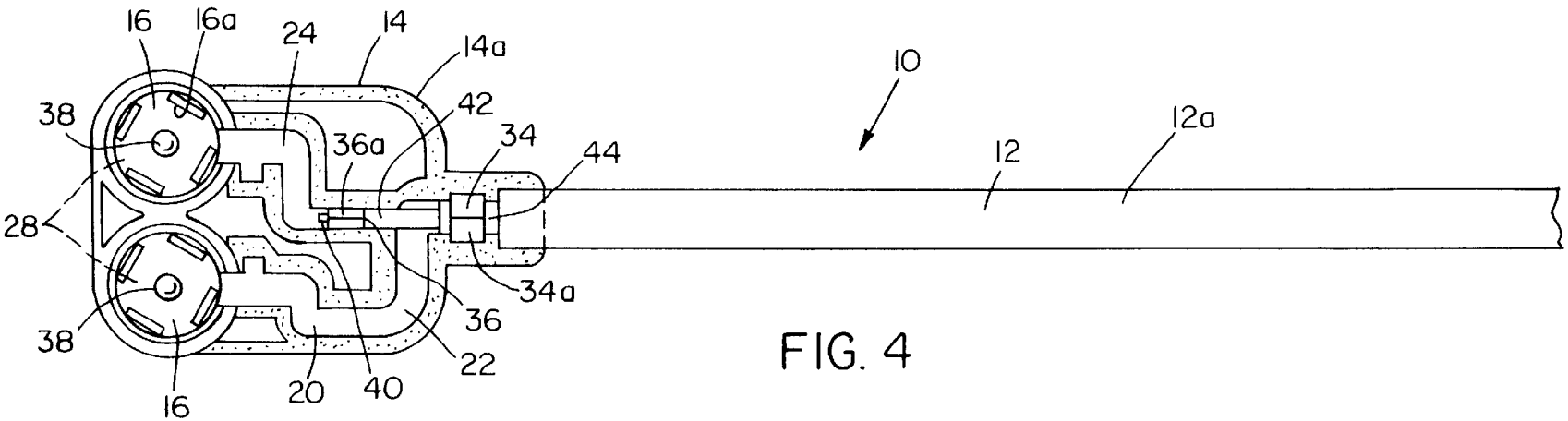
FIG. 4 is a bottom view of the cable assembly of FIG. 1 with the bottom surface of the housing removed to show the metallic insert.
Figure 5:
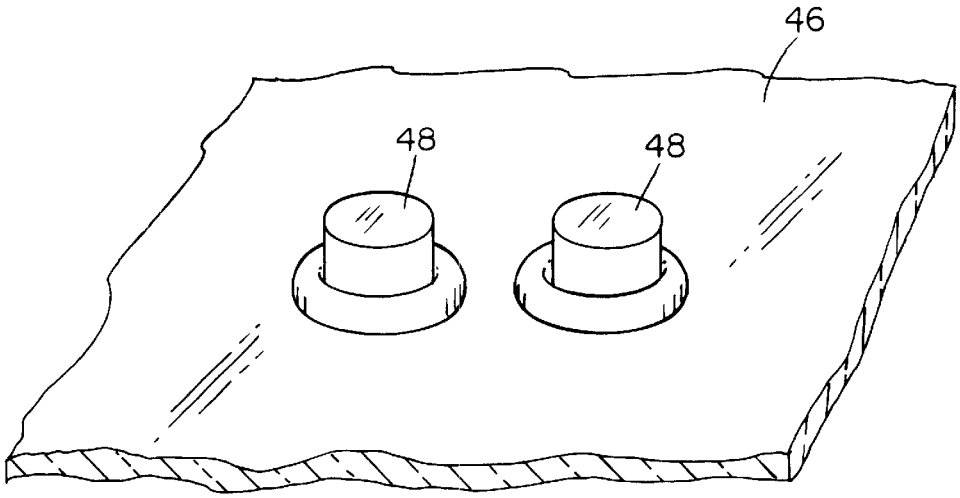
FIG. 5 is a perspective view of two electrical terminals soldered to a piece of glass for mating with the cable assembly of FIG. 1.

Referring to FIGS. 1–4, coaxial cable assembly 10 includes a length of coaxial cable 12 which is secured to a low profile connector head 14. Coaxial cable 12 has an outer insulative layer 12*a*, a braided metallic shield 44, an inner insulative layer 42, and a metallic inner core 40 (FIGS. 3 and 4). Connector head 14 includes a molded flexible polymeric insulative housing 14*a* which encapsulates or houses a metallic insert 20. The metallic insert 20 includes two generally flat lead portions 22/24 which are electrically connected to the coaxial cable 12 at one end and electrically connected to female circular connector members or sockets 16 at the other end (FIGS. 3 and 4). The sockets 16 include internal resilient contacts 16a shaped for firmly engaging a mating pair of circular male terminals 48 (FIG. 5), which may be for example, soldered to a piece of glass 46 such as a windshield or a rear window of an automobile. The sockets 16 extend at a right angle relative to the coaxial cable 12 with the ends thereof being only slightly beyond the lateral side of coaxial cable 12. Access to sockets 16 is provided by two openings 18 in the bottom of housing 14*a*. The low profile configuration of connector head 14 allows coaxial cable assembly 10 to be connected to mating terminals in a low profile manner (for example, close to the surface of a window 46) without employing an intermediate adapter. Such an arrangement is resistant to damage and is desirable when space is limited.

A more detailed description of cable assembly 10 now follows. Referring to FIGS. 3 and 4, lead portion 22 of insert 20 has a connecting portion 34 with opposed tabs 34*a* (FIGS. 6 and 7) at one end for crimping to the braided shield 44 of coaxial cable 12. Lead portion 24 includes a connecting portion 36 also having opposed tabs 36*a* at one end for crimping to the inner core 40 of coaxial cable 12. If desired, solder can be employed in conjunction with tabs 34*a*/36*a*, or instead of tabs 34*a*/36*a*. As can be seen in FIG. 4, the outer 12*a* and inner 42 insulating portions are stripped for exposing the shield 44 and inner core 40 for crimping thereon. Lead portion 22 is bent upwardly relative to lead portion 24 to be in proper alignment for crimping to braided shield 44 and for allowing the inner core 40 to extend therebelow (FIG. 3). Lead portion 24 is bent upwardly slightly to a lesser degree to account for the diameter of inner core 40 so as to be in proper alignment for crimping to inner core 40. Lead portions 22/24 also have lateral bends or changes in direction in order to place the connecting portions 34/36 in the proper alignment along a common axis X (FIG. 6) for securing to coaxial cable 12. In addition, the lateral bends also provide the necessary space for the insertion of tools required for crimping. The distal ends of lead portions 22/24 each include a circular portion 28 to which the sockets 16 are secured. Sockets 16 are cup-shaped so that the bottom walls of socket 16 are secured to the circular portions 28.

Figure 6:
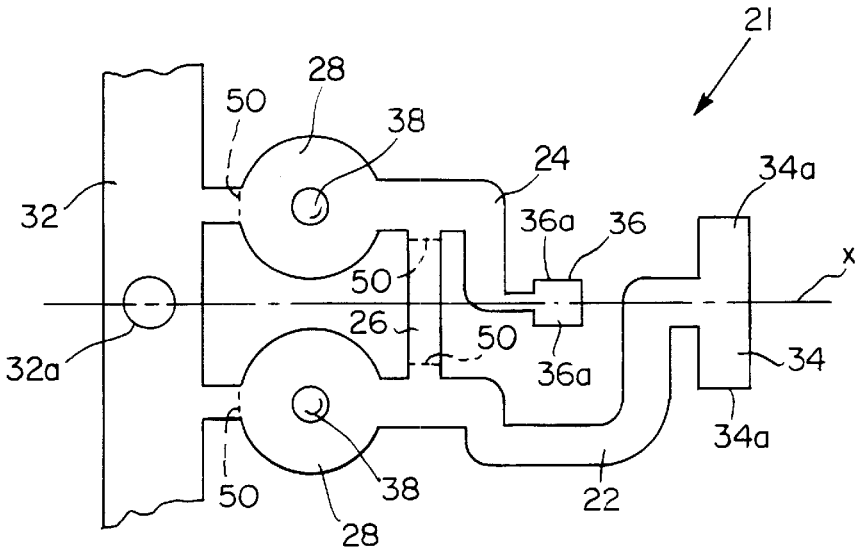
FIG. 6 is a plan view of a blank from which the metallic insert is formed.
Figure 7:
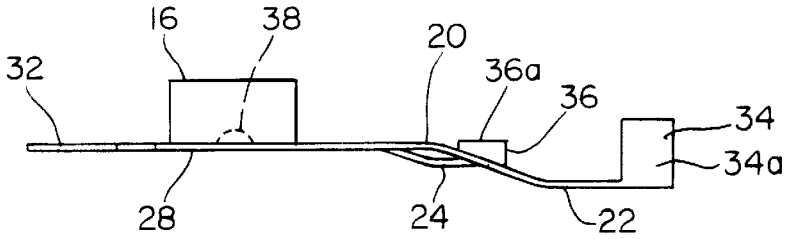
FIG. 7 is a side view of the metallic insert prior to crimping to the coaxial cable with the carrier strip attached thereto and tabs bent upwardly in preparation for crimping.

Insert 20 is formed from a flat blank 21 stamped from sheet metal (FIGS. 6 and 7). In the blank stage, lead portions 22/24 are connected together by a straight rib 26 extending therebetween. The circular portions 28 of lead portions 22/24 are connected together by a carrier strip 32 extending past the circular portions 28. The rib 26 and carrier strip 32 maintain the proper spacing of circular portions 28 from each other, and therefore, ultimately provide proper spacing between sockets 16. Prior to assembly with the coaxial cable 12, connector portions 34/36 are bent at right angles relative to lead portions 22/24 (FIG. 7) and lead portions 22/24 are bent relative to circular portions 28 as shown. The sockets 16 are then mounted to the circular portions 28 of insert 20. Sockets 16 are secured to circular portions 28 (FIGS. 6 and 7) of blank 21 by first positioning the sockets 16 on the circular portions 28 such that raised bumps 38 on the circular portions 28 extend through central holes in the bottom walls of sockets 16. The bumps 38 are then flattened such that material of the bumps spreads outwardly, thereby capturing and securing the sockets 16 to the circular portions 28. This method of securement is known as staking. Alternatively, sockets 16 may be secured by other conventional methods such as soldering or riveting.

When assembling insert 20 to coaxial cable 12, insert 20 is crimped to coaxial cable 12 with a tool that at the same time, cuts rib 26 and carrier 32 from insert 20 along the dotted lines 50 (FIG. 6). The lateral stiffness of the lead portions 22/24 allow the sockets 16 to maintain the proper spacing therebetween after rib 26 and carrier strip 32 are cut from insert 20. The cable 12/insert 20 assembly is then placed into a mold and housing 14*a* is molded over the end of coaxial cable 12, lead portions 22/24 and around sockets 16. If desired, the mold may include a jig for ensuring the proper spacing of sockets 16 during the molding of housing 14*a*. Sockets 16 are separated and insulated from each other by the insulative material of housing 14*a*. Preferably, sockets 16 are flush with the bottom of housing 14 or slightly recessed for protection. The flexibility of housing 14*a* allows connector head 14*a* to compensate for slight misaligments with terminals 48 (FIG.5) Housing 14a has a series of cavities adjacent to sockets 16 and lead portions 22/24 which provide further flexibility to the connector head 14. In addition, the cavities allow housing 14*a* to be made with less material. Housing 14*a* extends above and below coaxial cable 12 only very slightly, and therefore, does not add significant height to the cable assembly 10.

Figure 8:
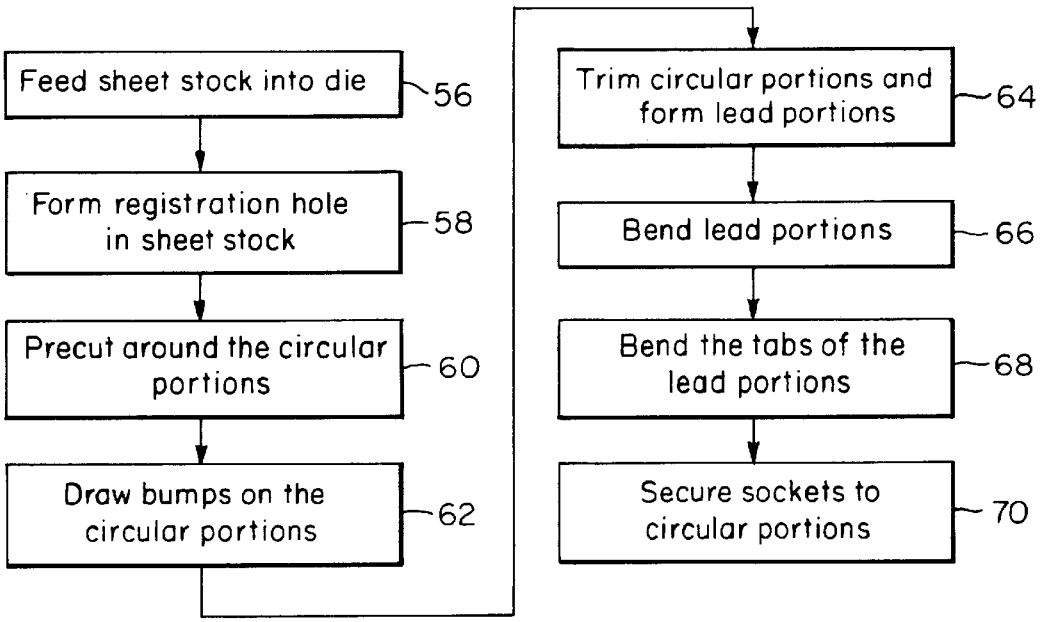
FIG. 8 is a flow chart depicting the steps of a method for forming the metallic insert.
Figure 9:
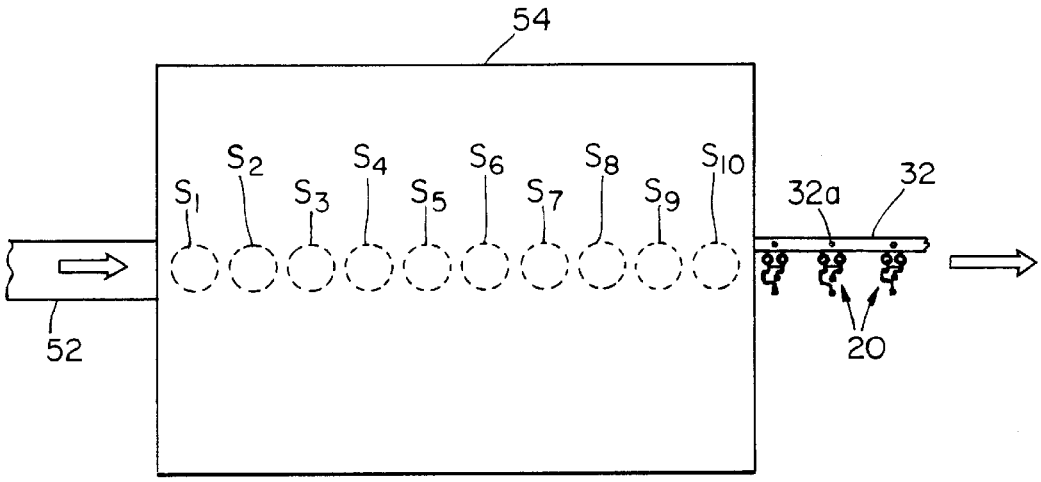
FIG. 9 is a plan view of sheet metal stock entering a forming die and exiting as a series of metallic inserts attached to a carrier strip.
Figure 10:
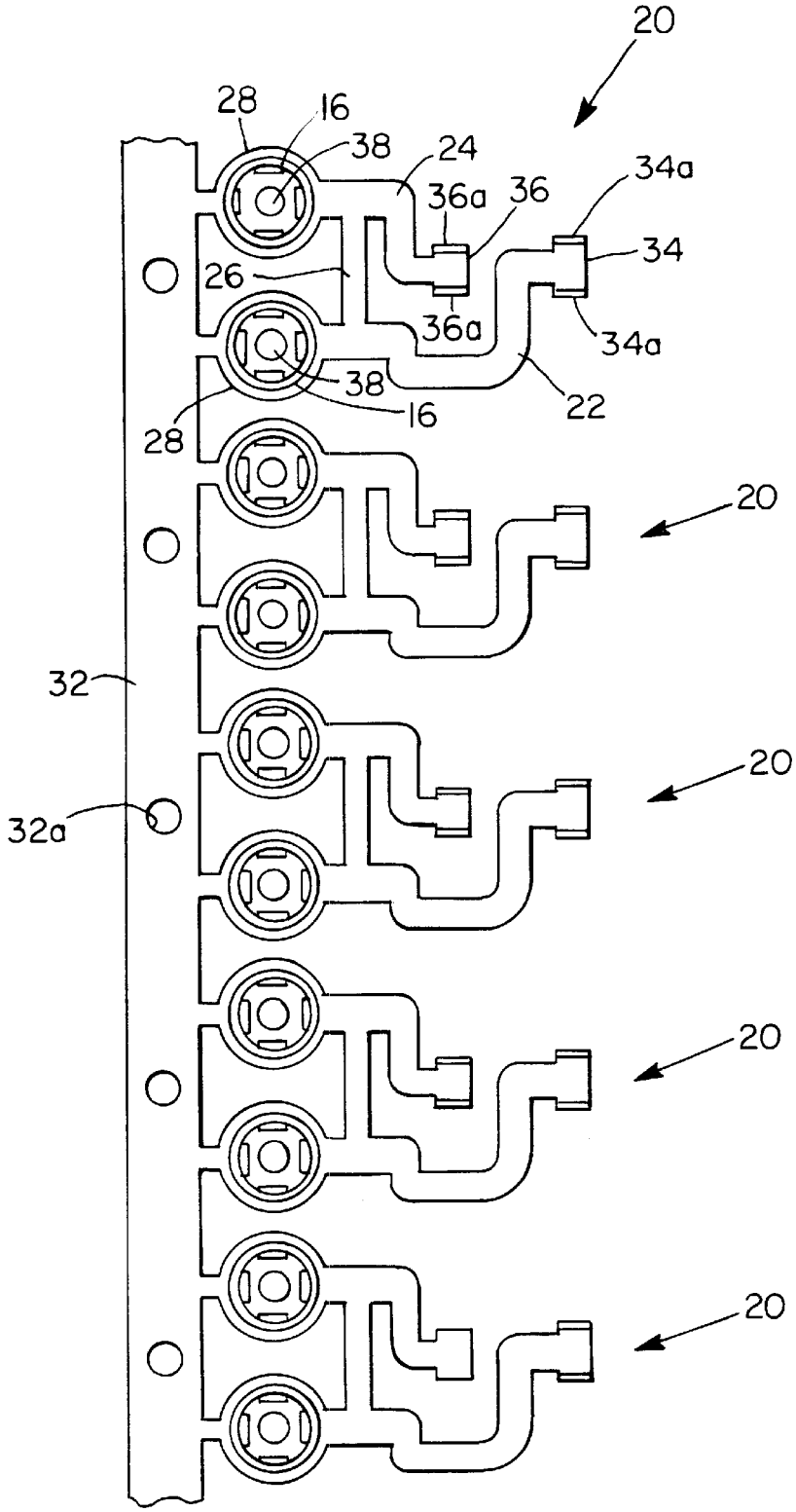
FIG. 10 is a plan view of a series of metallic inserts connected to a carrier strip.

FIGS. 8 and 9 depict one method of forming insert 20. In step 56 (FIG. 8), a strip of sheet metal stock 52 (FIG. 9) is fed into a progressive forming die 54. The forming die 54 has a number of cutting, bending, drawing and forming stations $S_1$–$S_{10}$ positioned in line with each other for progressively forming the sheet metal stock 52 into a series of inserts 20. In step 58, a registration hole 32*a* (FIG. 6) is formed in the sheet metal stock 52 at the first station $S_1$. In step 60, at the second station S2, the sheet metal stock 52 is precut around rough circular regions which will later become the circular portions 28. Typically, the precuts leave the rough circular regions with a radius about 1/16 inch greater than the finished circular portions 28. In step 62, raised central bumps 38 are formed in the rough circular regions by a drawing process which is conducted in three progressive stations (third through fifth stations, $S_3$–$S_5$). The drawing process shrinks the rough circular regions to a size that is that close to the size of the finished circular portions 28. In step 64, the circular portions 28 are trimmed at a sixth station $S_6$ while the rib 26 and lead portions 22/24 are cut at a seventh station $S_7$. In step 66, the lead portions 22/24 are bent relative to circular portions 28 in the configuration depicted in FIG. 7 at an eighth station $S_8$. In step 68, the tabs 34/36 are bent upwardly relative to lead portions 22/24 (FIGS. 7 and 10) at a ninth station $S_9$ to form U-shaped cradles for accepting the corresponding portions 40/44 of coaxial cable 12. Finally, in step 70, at a tenth station $S_{10}$, sockets 16 are positioned on circular portions 28 and secured thereto by flattening bumps 38 in a staking process as previously mentioned. Since the sheet metal stock 52 is progressively moved through die 54, these operations are performed at the same time so that a continuous ribbon emerges from die 54 consisting of a series of inserts 20 attached to a carrier strip 32 (FIGS. 9 and 10). This continuous strip configuration is well suited for use with machinery for automated assembly. Although particular operations have been described with respect to FIG. 8, it is understood that certain steps and/or stations may be omitted, combined or added. In addition, although sockets 16 are described to be secured to circular portions 28 by die 54, alternatively, sockets 16 may be secured thereto at a later time by another machine. In such a case, the blanks 21 may be stored on a spool in preparation for securing to sockets 16. After securement, the inserts 20 may also be stored on a spool.

In one embodiment, connector head 14 is about 39 mm long, 25.4 mm wide and 8.7 mm high. In addition, sockets 16 are spaced about 12.7 mm apart from center to center. Insert 20 is about 33 mm. long and 22.2 mm. wide. Circular portions 28 are about 9.5 mm. in diameter. Lead portion 24 is bent down from circular portions 28 (FIG. 7) about 1 mm. and lead portion 22 is bent down from circular portions 28 about 2.3 mm. Registration hole 32*a* in carrier strip 32 is aligned with the axis X. The registration hole 32*a* is used to index the carrier strip 32 during the assembly of insert 20 with coaxial cable 12. The inserts 20 are positioned relative to each other on carrier strip 32 about 24.13 mm. apart center to center. The combined width of carrier strip 32 and insert 20 is about 41 mm. When rib 26 is removed, small portions therefrom remain extending from lead portions 22 and 24. Blank 21 is formed from brass and sockets 16 are formed of nickel plated steel. Alternative materials for blank 21 are copper, aluminum or steel.

Figure 11:
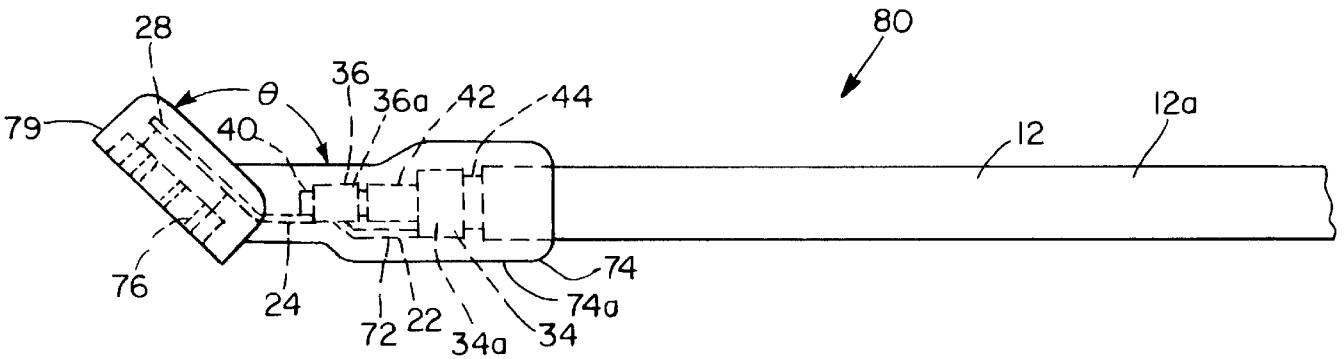
FIG. 11 is a side view of another embodiment of the present invention cable assembly.
Figure 12:
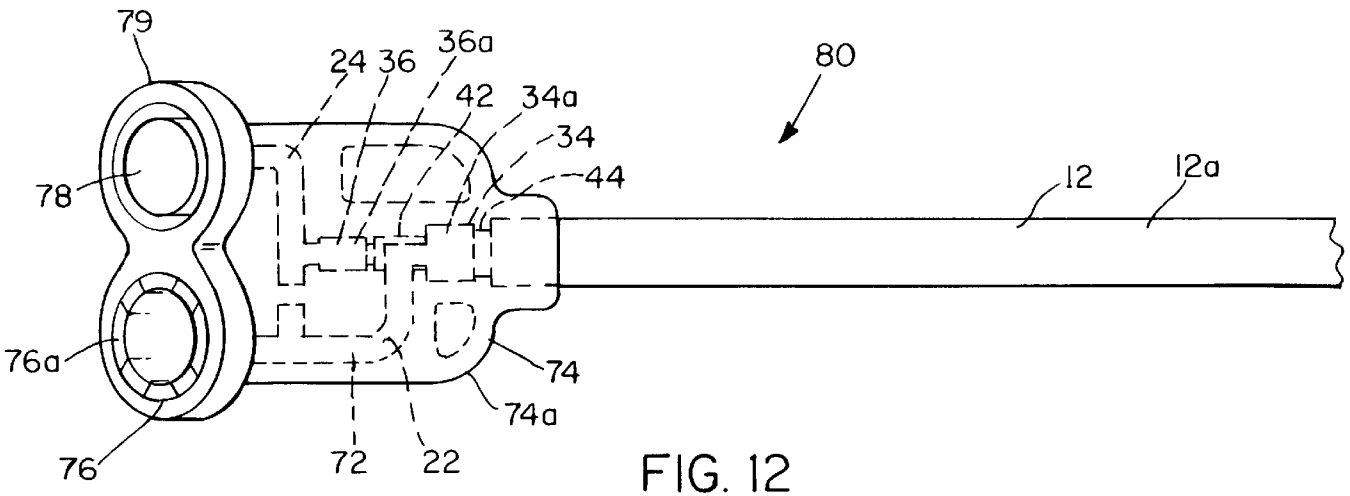
FIG. 12 is a bottom view of the cable assembly of FIG. 11.

Referring to FIGS. 11 and 12, coaxial cable assembly 80 is another embodiment of the present invention which differs from cable assembly 10 in that cable assembly 80 has an insert 72 that is bent at an angle θ between the circular portions 28 and lead portions 22/24 so that connector members 76/78 which are secured to insert 72, extend downwardly from insert 72 at an angle relative to cable 12. As can be seen in FIG. 11, the crimping tabs 34*a*/36*a* extend upwardly in contrast to insert 20 (FIG. 3) where tabs 34*a*/36*a* extend downwardly. The connector members 76/78 include one circular female socket 76 and one circular male connector 78 for engaging mating terminals. The female socket 76 includes a circular series of resilient contacts 76*a*. The male/female configuration assures that cable assembly 80 cannot be incorrectly connected (backwards) with the mating terminals. The connector members 76/78 are secured to the circular portions 28 of insert 72 and extend downwardly away from cable 12 at an angle. In the embodiment depicted in FIGS. 11 and 12, insert 72 is bent at an angle of θ=135°. Alternatively, other suitable angles may be chosen depending upon the situation at hand. As seen in FIG. 12, the lead portions 22/24 of insert 72 may have slightly different lateral bends or shapes than the lead portions 22/24 of insert 20 (FIG. 4). The housing 74*a* of connector head 74 is molded around insert 72 and includes a bent distal end 79 which accommodates the bent insert 72. The distal end 79 houses the connector members 76/78. As with insert 20, insert 72 includes a rib (shown removed in FIG. 12) which is cut during crimping to cable 12. Connector members 76/78 may be staked to the circular portions 28 or secured by other suitable means. The circular female socket 76 may be configured as shown, but alternatively, may be replaced with socket 16 (FIG. 2). The circular male connector 78 may be either solid or hollow, depending upon the situation at hand.

While this invention has been particularly shown and described with references to preferred embodiments thereof, it will be understood by those skilled in the art that various changes in form and details may be made therein without departing from the scope of the invention encompassed by the appended claims.

For example, although specific dimensions and materials have been described above, the dimensions and materials may vary depending on the application at hand. In addition, although cable assemblies 10 and 80 have been described for mating with terminals soldered to automotive glass, alternatively, the present invention may be connected to terminals in other applications. Furthermore, although cable assemblies 10 and 80 have been depicted to include circular female sockets 16/76 and circular male connectors 78 as the connector members, it is understood that cable assemblies 10 and 80 may have other types of sockets, such as for engaging a blade connector, pin connector, etc., or include the male version of those configurations. The connector members may also be integrally formed with the lead portions 22/24 and may also extend longitudinally relative to the coaxial cable rather than at a right angle. Although terms such as "upwardly,""down,""therebelow" and "lateral" have been used to describe the present invention, such terms describe components as depicted in the particular orientation of the drawings and are not intended to limit the orientation of the present invention or any components therein. Although a one piece flexible housing has been described to be molded over cable 12 and inserts 20 or 72, alternatively, the housing may be rigid or formed in two pieces and assembled thereover. Instead of forming lead portions 22/24 from sheet metal, lead portions 22/24 may be molded. Also, the sheet metal lead portions 22/24 may be replaced with wires that are secured to cable 12 and the connector members. Inserts 20 and 72 may also be secured to conductors of non-coaxial cables. Finally, features of cable assemblies 10 and 80 may be combined or omitted.

What is claimed is:

1. A cable assembly comprising:

a coaxial cable having an inner core and an outer shield;

first and second lead portions aligned with the coaxial cable and formed from sheet metal, the lead portions being positioned laterally flat side by side and each having at one end a connecting portion, the connecting portion of one lead portion being attached to the inner core and the connecting portion of the other lead portion being attached to the outer shield, each lead portion being laterally configured to position the connecting portions along a common axis for securing to the inner core and the outer shield; and first and second connector members extending from respective lead portions, the connector members being positioned in side by side relation for mating with side by side terminals.

2. The assembly of claim 1 further comprising an insulative housing for surrounding the lead portions and at least part of the connector members.

3. The assembly of claim 2 in which the insulative housing is formed of molded of polymer.

4. The assembly of claim 1 in which the first and second connector members extend at an angle relative to the coaxial cable.

5. The assembly of claim 4 in which the angle is a right angle.

6. The assembly of claim 1 in which at least one of the connector members is female.

7. The assembly of claim 6 in which the at least one female connector member includes a socket that is shaped for engaging a circular male terminal.

8. The assembly of claim 7 in which both connector members are female.

9. The assembly of claim 7 in which one of the connector members is a circular male connector.

10. The assembly of claim 1 in which the lead portions include tabs for crimping to the inner core and outer shield of the coaxial cable.

11. The assembly of claim 10 in which at least one of the connector members is secured to one of the lead portions by staking.

12. The assembly of claim 11 in which the first and second lead portions are part of an insert wherein the first and second lead portions are joined together by a rib that is cut from the lead portions when the lead portions are crimped to the inner core and the outer shield, the rib for providing proper spacing between the first and second connector members.

13. A cable assembly comprising:

a coaxial cable having an inner core and an outer shield;

first and second lead portions aligned with the coaxial cable and formed from sheet metal, the lead portions being positioned laterally flat side by side and each having at one end a connecting portion, the connecting portion of one lead portion being attached to the inner core and the connecting portion of the other lead portion being attached to the outer shield, each lead portion being laterally configured to position the connecting portions along a common axis for securing to the inner core and the outer shield;

first and second connector members secured to respective first and second lead portions and oriented at an angle relative to the coaxial cable, the connector members being positioned in side by side relation for mating with side by side terminals; and an insulative housing surrounding the lead portions and at least part of the connector members.

14. The assembly of claim 13 in which the insulative housing is formed of molded polymer.

15. The assembly of claim 13 in which the first and second connector members are oriented at a right angle relative to the coaxial cable.

16. The assembly of claim 13 in which at least one of the connector members is female.

17. The assembly of claim 16 in which the at least one female connector member includes a socket that is shaped for engaging a circular male terminal.

18. The assembly of claim 17 in which both connector members are female.

19. The assembly of claim 17 in which one of the connector members is a circular male connector.

20. The assembly of claim 13 in which the lead portions include tabs for crimping to the inner core and outer shield of the coaxial cable.

21. The assembly of claim 20 in which at least one of the connector members is secured to a lead portion by staking.

22. The assembly of claim 21 in which the first and second lead portions are part of an insert wherein the first and second lead portions are joined together by a rib that is cut from the lead portions when the lead portions are crimped to the inner core and the outer shield, the rib for providing proper spacing between the first and second connector members.

23. A conductive sheet metal insert for a cable assembly including a coaxial cable with an inner core and an outer shield comprising:

first and second lead portions for alignment with the coaxial cable, the lead portions being positioned laterally flat side by side and each having at one end a connecting portion, the connecting portion of one lead portion for crimping to an inner core of the coaxial cable and the connecting portion of the other lead portion for crimping to the outer shield of the coaxial cable, each lead portion being laterally configured to position the connecting portions along a common axis for securing to the inner core and the outer shield;

first and second connector members extending from respective lead portions in side by side relation for engaging mating terminals; and a rib joining the lead portions together, the rib providing proper spacing between the connector members, the rib for being cut from the lead portions when the lead portions are crimped to the coaxial cable.

24. A method of forming a cable assembly comprising the steps of:

providing a coaxial cable having an inner core and an outer shield;

providing first and second lead portions aligned with the coaxial cable and formed from sheet metal, the lead portions being positioned laterally flat side by side and each having at one end a connecting portion, the connecting portion of one lead portion being attached to the inner core and the connecting portion of the other lead portion being attached to the outer shield, each lead portion being laterally configured to position the connecting portions along a common axis for securing to the inner core and the outer shield; and extending first and second connector members from respective lead portions, the connector members being positioned in side by side relation for mating with side by side terminals.

25. The method of claim 24 further comprising the step of surrounding the lead portions and at least part of the connector members within an insulative housing.

26. The method of claim 25 further comprising the step of forming the insulative housing from molded polymer.

27. The method of claim 24 further comprising the step of extending the first and second connector members at an angle relative to the coaxial cable.

28. The method of claim 27 further comprising the step of extending the connector members at a right angle relative to the coaxial cable.

29. The method of claim 24 further comprising the step of making at least one of the connector members female.

30. The method of claim 29 further comprising the step of providing the at least one female connector member with a female socket that is shaped for engaging a circular male terminal.

31. The method of claim 30 further comprising the step of making both connector members female.

32. The method of claim 30 further comprising the step of making one of the connector members a circular male connector.

33. The method of claim 24 further comprising the step of providing the lead portions with tabs for crimping to the inner core and the outer shield of the coaxial cable.

34. The method of claim 33 further comprising the step of securing at least one of the connector members to a lead portion by staking.

35. The method of claim 34 further comprising the step of forming the first and second lead portions from an insert wherein the first and second lead portions are joined together by a rib that is cut from the lead portions when the lead portions are crimped to the inner core and the outer shield, the rib for providing proper spacing between the first and second connector members.

36. A method of forming a cable assembly comprising the steps of:

providing a coaxial cable having an inner core and an outer shield;

providing a sheet metal insert having first and second lead portions that are aligned with the coaxial cable and formed from sheet metal, the lead portions being positioned laterally flat side by side and each having at one end a connecting portion, each lead portion being laterally configured to position the connecting portions along a common axis for securing to the inner core and the outer shield, the lead portions being joined together by a rib, first and second connector members extending from respective lead portions in side by side relation, the rib for providing proper spacing between the first and second connector members;

crimping connecting portions of the first and second lead portions to the coaxial cable, the connecting portion of one lead portion to the inner core and the connecting portion of the other lead portion to the outer shield; and cutting the rib from the lead portions to disconnect the lead portions from each other.

37. The method of claim 36 further comprising the step of molding an insulative housing of polymer around the first, and second lead portions and at least part of the connector members.

38. The method of claim 36 further comprising the step of extending the first and second connector members at an angle relative to the coaxial cable.

39. The method of claim 36 in which at least one of the connector members is a female socket that is shaped for engaging a circular male terminal, the method further comprising the step of securing the at least one female socket to a lead portion by staking.

40. The method of claim 39 further comprising the step of making both connector members female.

41. The method of claim 39 further comprising the step of making one of the connector members a circular male connector.

* * * * *